US009318098B2

(12) United States Patent
Chew et al.

(10) Patent No.: US 9,318,098 B2
(45) Date of Patent: Apr. 19, 2016

(54) TUBE SYSTEM AND LIFE TUBE ADAPTOR FOR A HEARING AID

(71) Applicant: SIVANTOS PTE. LTD., Singapore (SG)

(72) Inventors: Han Seong Chew, Singapore (SG); Beng Hai Tan, Singapore (SG)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/621,704

(22) Filed: Feb. 13, 2015

(65) Prior Publication Data

US 2015/0228268 A1 Aug. 13, 2015

(30) Foreign Application Priority Data

Feb. 13, 2014 (EP) ..... 14155051

(51) Int. Cl.
*H04R 25/00* (2006.01)
*G10K 11/22* (2006.01)

(52) U.S. Cl.
CPC ..... *G10K 11/22* (2013.01); *H04R 25/00* (2013.01); *H04R 25/60* (2013.01); *H04R 25/608* (2013.01); *H04R 2225/021* (2013.01); *H04R 2225/63* (2013.01); *H04R 2460/17* (2013.01)

(58) Field of Classification Search
CPC ..... H04R 1/1008; H04R 25/00
USPC ..... 181/129
See application file for complete search history.

(56) References Cited

U.S. PATENT DOCUMENTS

| | | | | |
|---|---|---|---|---|
| 4,381,830 | A * | 5/1983 | Jelonek et al. | 181/129 |
| 5,249,234 | A * | 9/1993 | Butler | 381/322 |
| 5,975,235 | A * | 11/1999 | Schlaegel et al. | 181/129 |
| 7,522,743 | B2 * | 4/2009 | Dobras et al. | 381/381 |
| 7,931,027 | B2 * | 4/2011 | Topholm et al. | 128/864 |
| 2002/0096391 | A1 * | 7/2002 | Smith et al. | 181/135 |
| 2006/0171549 | A1 * | 8/2006 | Holmes | 381/330 |
| 2008/0232628 | A1 * | 9/2008 | Ho et al. | 381/330 |
| 2012/0082331 | A1 * | 4/2012 | Meosky et al. | 381/323 |
| 2014/0016808 | A1 * | 1/2014 | Cherukuri et al. | 381/324 |
| 2014/0150234 | A1 * | 6/2014 | Shennib et al. | 29/428 |

* cited by examiner

*Primary Examiner* — Forrest M Phillips
(74) *Attorney, Agent, or Firm* — Laurence A. Greenberg; Werner H. Stemer; Ralph E. Locher

(57) ABSTRACT

A hearing aid includes a body and an ear piece. A life tube is disposed between the hearing aid body and the ear piece for guiding sound from a receiver in the hearing aid body to the ear of the wearer. In order to adapt the hearing aid to different wearers with different ear conches, a tube system is provided with an adaptable length.

6 Claims, 14 Drawing Sheets

TUBE SYSTEM AND LIFE TUBE ADAPTOR FOR A HEARING AID

CROSS-REFERENCE TO RELATED APPLICATION

This application claims the priority, under 35 U.S.C. §119, of European Patent Application EP 14 155 051.7, filed Feb. 13, 2014; the prior application is herewith incorporated by reference in its entirety.

BACKGROUND OF THE INVENTION

Field of the Invention

The invention relates to a tube system and a life tube adaptor for a hearing aid having a body and an ear piece. The life tube is provided between the hearing aid body and the ear piece for guiding sound from a receiver in the hearing aid body to the ear of the wearer.

The size of the concha and the position of a behind the ear hearing aid in relation to the ear canal differ due to individual physical properties of the wearer. A great variety in length and shape of sound tubes is required for physically fitting a hearing aid to a wearer.

SUMMARY OF THE INVENTION

It is accordingly an object of the invention to provide a tube system and a life tube adaptor for a hearing aid, which overcome the hereinafore-mentioned disadvantages of the heretofore-known devices of this general type and which simplify a physical fitting procedure.

With the foregoing and other objects in view there is provided, in accordance with the invention, a tube system for a hearing aid having a hearing aid body with a receiver and an ear piece. The tube system, which is configured for providing a sound connection between the hearing aid body and the ear piece, has an adjustable length.

Since the length of the tube system is adjustable, it is an advantage that less tube system sizes are required for physically fitting a hearing aid to all types of wearers.

In accordance with another feature of the invention, the tube system includes a tube and an adaptor for connecting the tube to the ear piece or the hearing aid body, wherein the adaptor is releasably connectable to the tube.

The releasably connected adaptor makes it possible to shorten the tube and connect the adaptor to the tube, thereby providing a tube system of adjustable length.

In accordance with a further feature of the tube system of the invention, the length of the adaptor is adjustable.

The adjustable length of the adaptor makes it possible to adapt the length of the tube system by changing the length of the adaptor.

In accordance with an added feature of the tube system of the invention, a locking element is provided for locking a connection between the tube and the adaptor.

The locking element advantageously fixes the tube to the adaptor while allowing easy connection of the tube to the adaptor before the locking element is applied.

With the objects of the invention in view, there is also provided an adaptor for a tube system, comprising an integrally formed insertion tool for inserting the adaptor into the tube. The insertion tool is releasably connected to the adaptor.

Since the parts of a hearing aid are small, it is difficult to handle those parts. By providing an insertion tool integrally formed with the adaptor, it is ensured that the adaptor cannot get lost and is easier to handle.

In accordance with another feature of the adaptor of the invention, an element with adjustable length is integrally formed with the tube.

This makes the tube itself adjustable in length without manipulating and connecting different parts.

In accordance with a further feature of the adaptor of the invention, the tube system includes two tube segments with a connector element for connecting the two tube segments releasably.

By connecting two tube segments with a connector, it is advantageously possible to provide a great variety of different tube lengths with a much smaller number of tube segment sizes.

In accordance with an added feature of the adaptor of the invention, the length of the connector element is adjustable. This may be in the form of a connector element which may be cut in length or may provide a telescopic slide-out.

In accordance with an additional feature of the adaptor of the invention, the connector element provides two sub-elements for connecting to the tube segments and at least a third sub-element for interconnecting the two sub-elements for connecting the tube.

The length of the tube system may easily be adjusted by inserting a single third sub-element with different lengths or inserting a different number of third elements stacked in series.

In accordance with a concomitant feature of the adaptor of the invention, the connector element provides two sub-elements for connecting to the tube, wherein the sub-elements (first and second sub-elements) provide devices for releasably engaging in a plurality of positions relative to each other. Such devices may be circumferential grooving provided at an inner and an outer side of the first and second connectors, which engage if the first sub-element is plugged into the second sub-element.

Other features which are considered as characteristic for the invention are set forth in the appended claims.

Although the invention is illustrated and described herein as embodied in a tube system and a life tube adaptor for a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
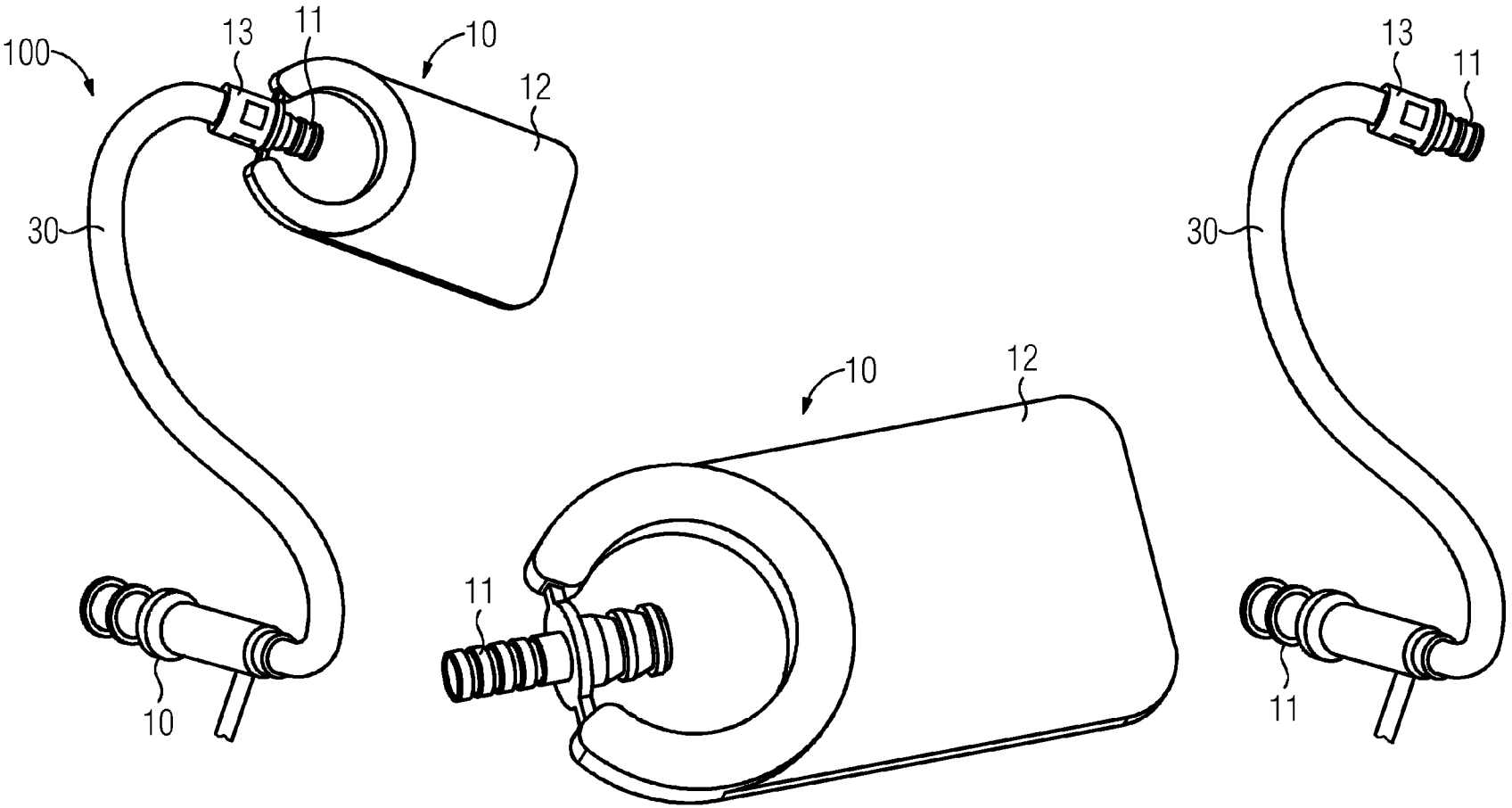
FIG. 1 includes diagrammatic, exploded and assembled, perspective views of an example of a tube system and an adaptor according to the present invention.

Referring now to the figures of the drawings in detail and first, particularly, to FIG. 1 thereof, there is seen a tube system 100 including a tube 30 and adaptors 10 connected to each end of the tube 30. One of the adaptors 10 is provided with an insertion tool 12. The Adaptor 10 is fixed by a locking element 13 to the tube 30. The adaptor 10 may include an adaptor body 11 and an insertion tool 12 which may be integrally formed with the adaptor body 11, e.g. by molding the adaptor body 11 and the insertion tool 12 from plastics. The adaptors 10 or connectors 20 (see FIG. 10) could also be made from metal.

Figure 2:
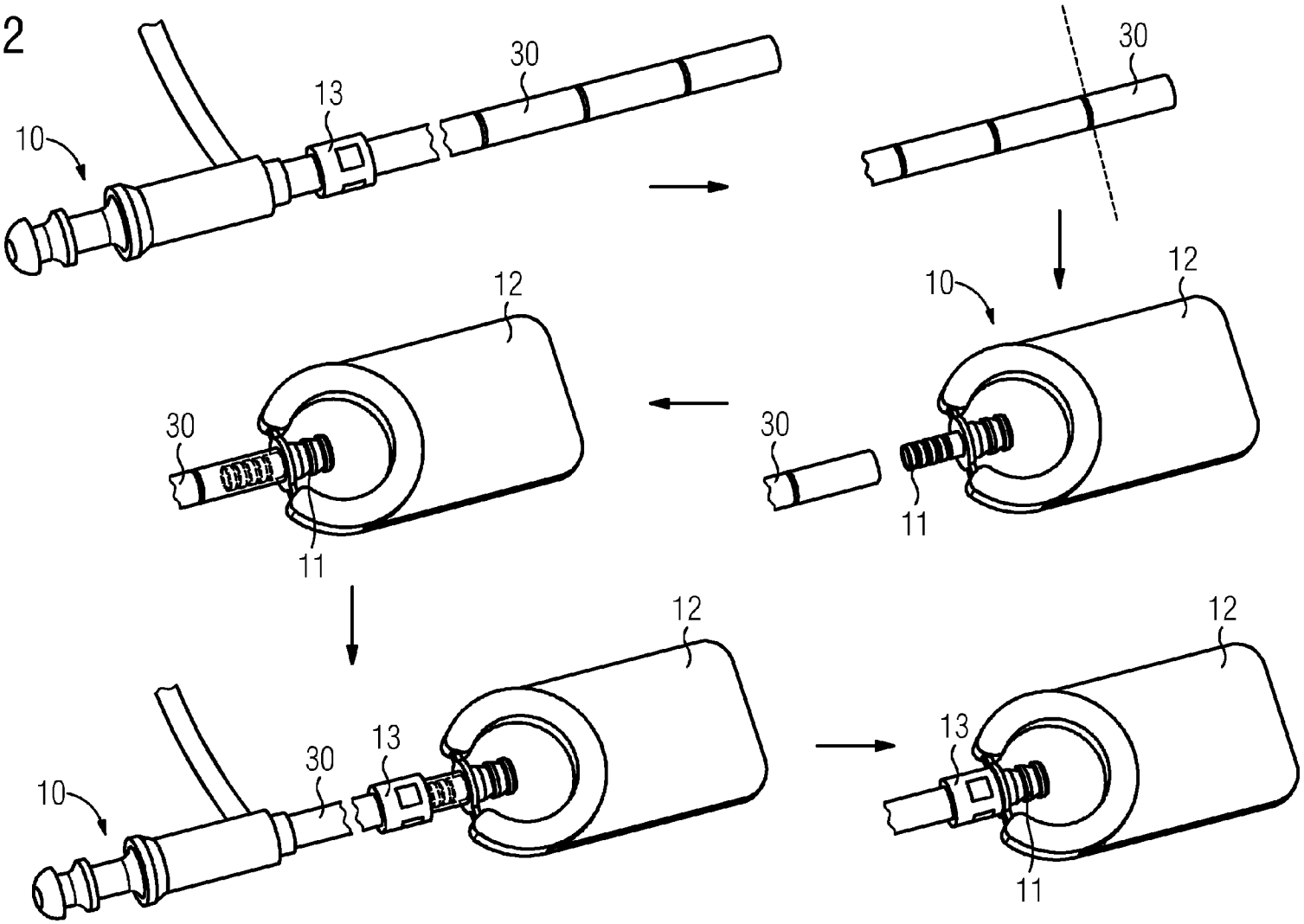
FIG. 2 is a fragmentary, perspective view showing details with regard to adjusting a length of a tube system.

FIG. 2 shows in detail, how an adaptor 10 is fixed to the tube 30. First, the adaptor body 11 is inserted into the tube 30 by holding and moving the insertion tool 12. After the adaptor body 11 is inserted into the tube 30, the locking element 13 is moved over the tube 30 and the adaptor body 11, thereby fixing the tube by squeezing it in between. Eventually, the insertion tool is removed from the adaptor body by bending the insertion tool relatively to the adaptor body 11 and thereby twisting a flange between the adaptor body 11 and the insertion tool 12.

In the same way, connectors 20 maybe inserted by using an insertion tool integrally formed with the connector. It is also possible according to the invention to use a locking element to fix the tube to a connector 20.

Figure 3:
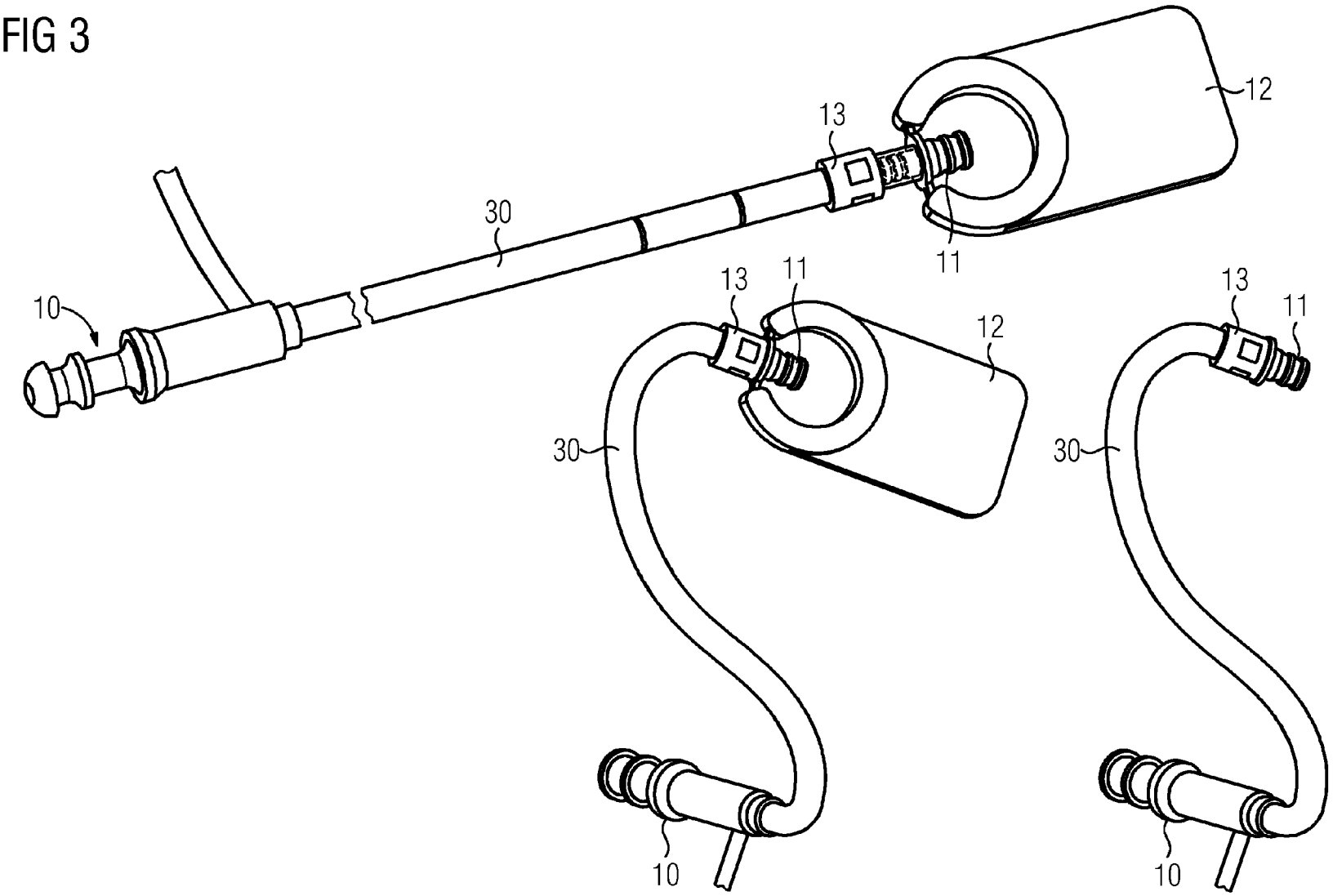
FIG. 3 is a perspective view showing details with regard to adjusting the length of a tube system.

FIG. 3 shows in the procedure of FIG. 2 in greater detail.

Figure 4:
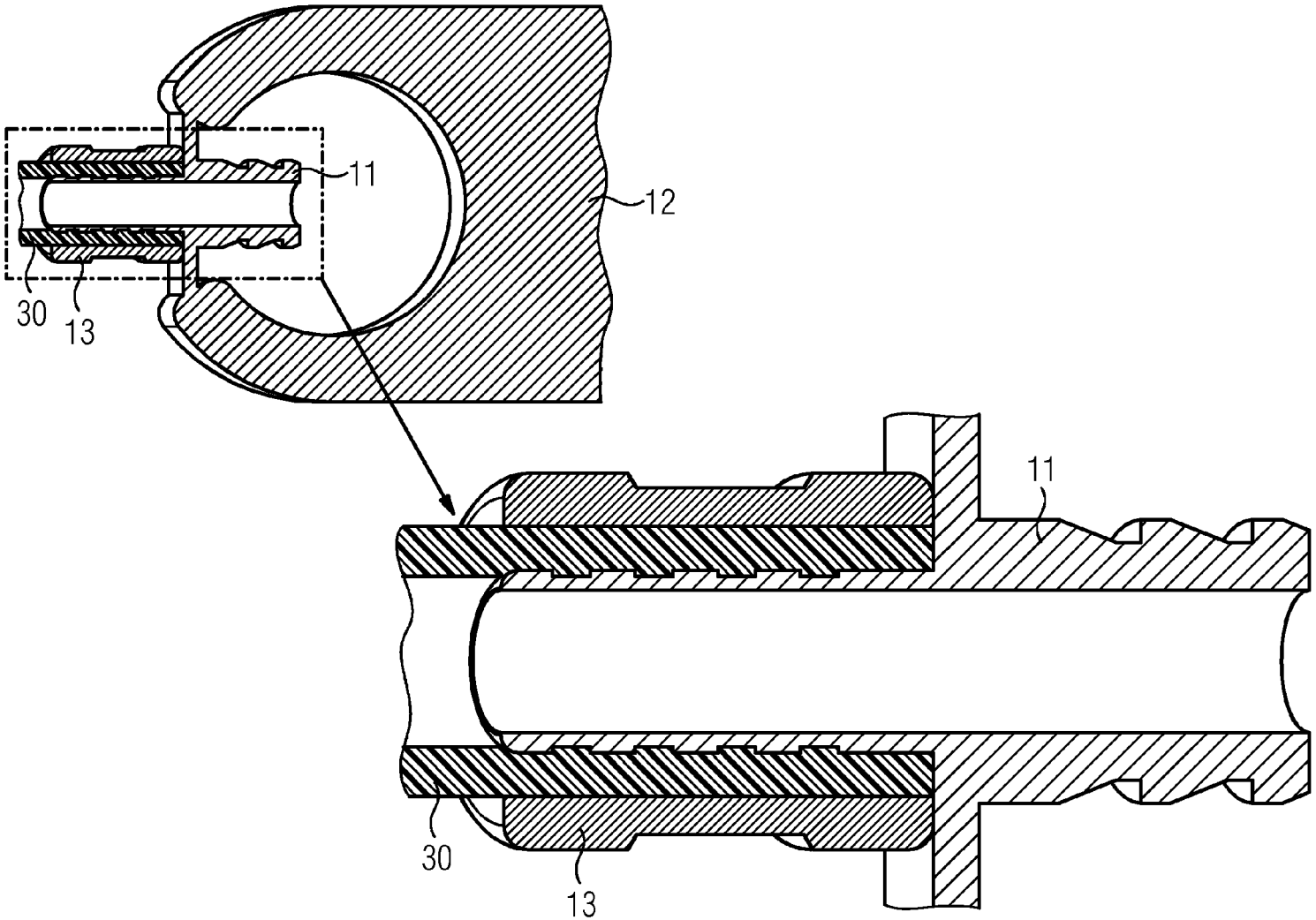
FIG. 4 is a longitudinal-sectional view showing an example of an adaptor and a locking element according to the present invention.

FIG. 4 shows in detail, how the tube 30 is locked between the locking element 13 and the adaptor body 11. For a better grip, circumferential groves or bumps are provided at the exterior of the adaptor body 11.

Figure 5:
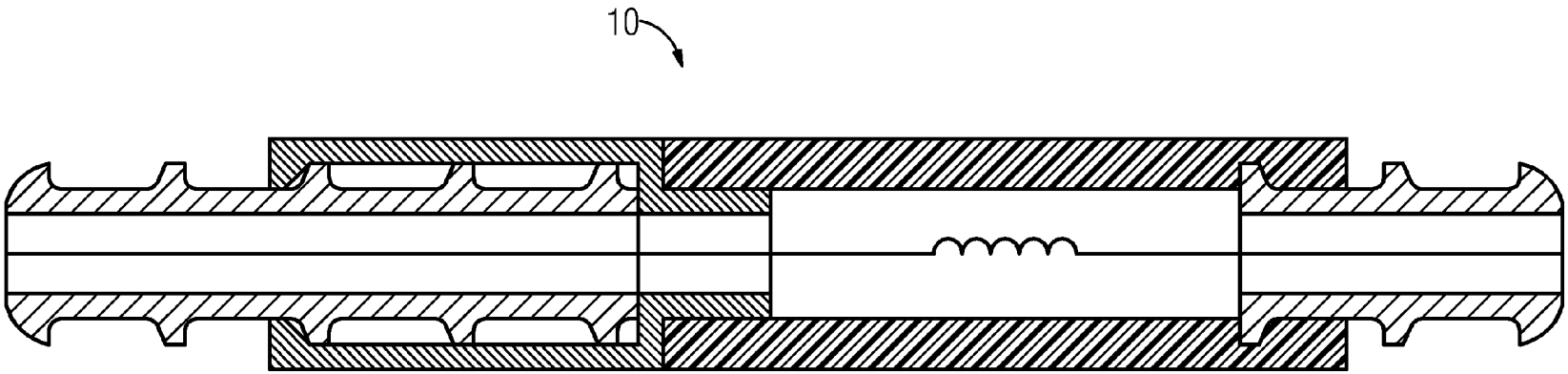
FIG. 5 is a longitudinal-sectional view showing an example of an adaptor being adjustable in length according to the present invention.

FIG. 5 shows an adaptor with a telescopic slide-out to adjust the length of the adaptor 10.

Figure 6:
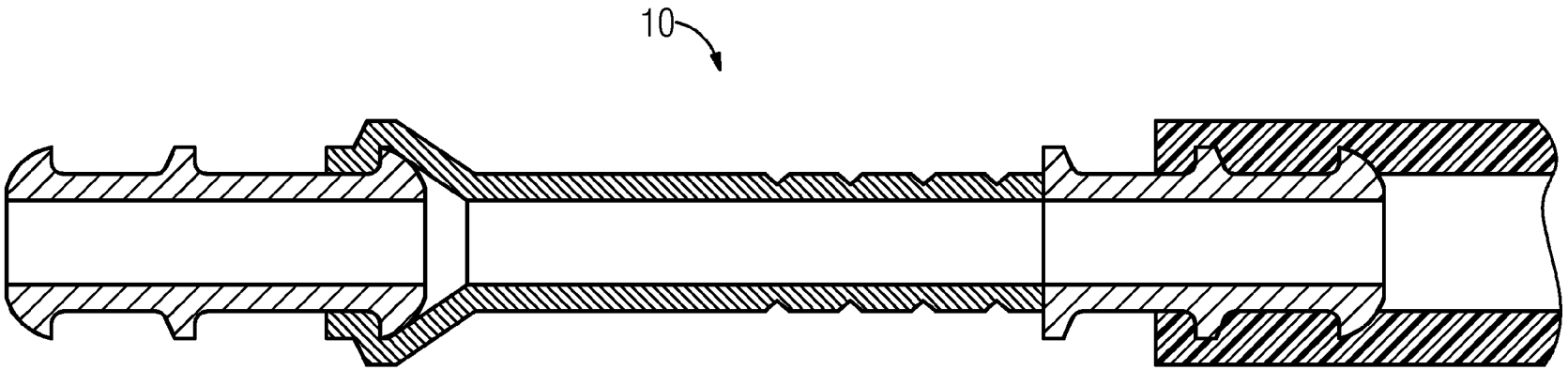
FIG. 6 is a longitudinal-sectional view showing another example of an adaptor being adjustable in length according to the present invention.

FIG. 6 shows an adaptor 10 provided with circumferential grooves to make it possible to cut the adaptor to different lengths.

Figure 7:
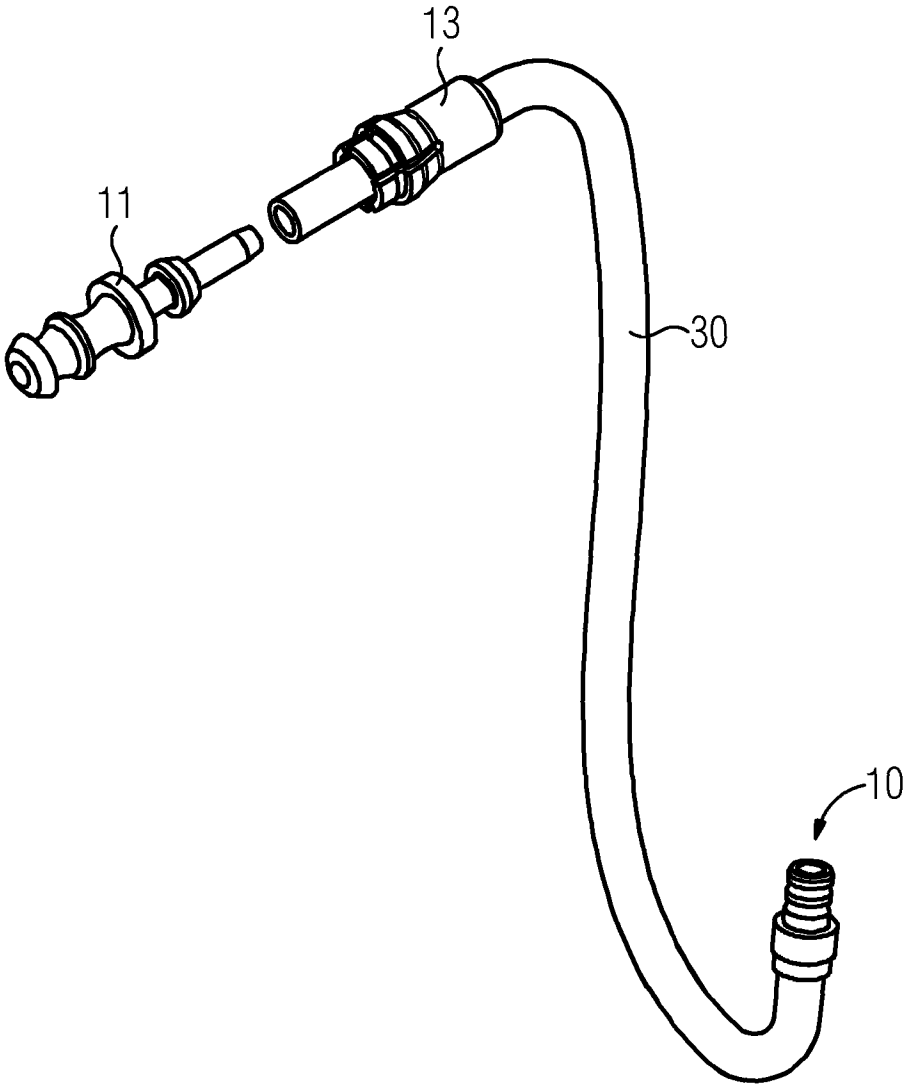
FIG. 7 is a perspective view of an example of a tube system with a locking element according to the present invention.

FIG. 7 shows a disassembled tube system 100 wherein the adaptor 10 is not yet inserted.

Figure 8:
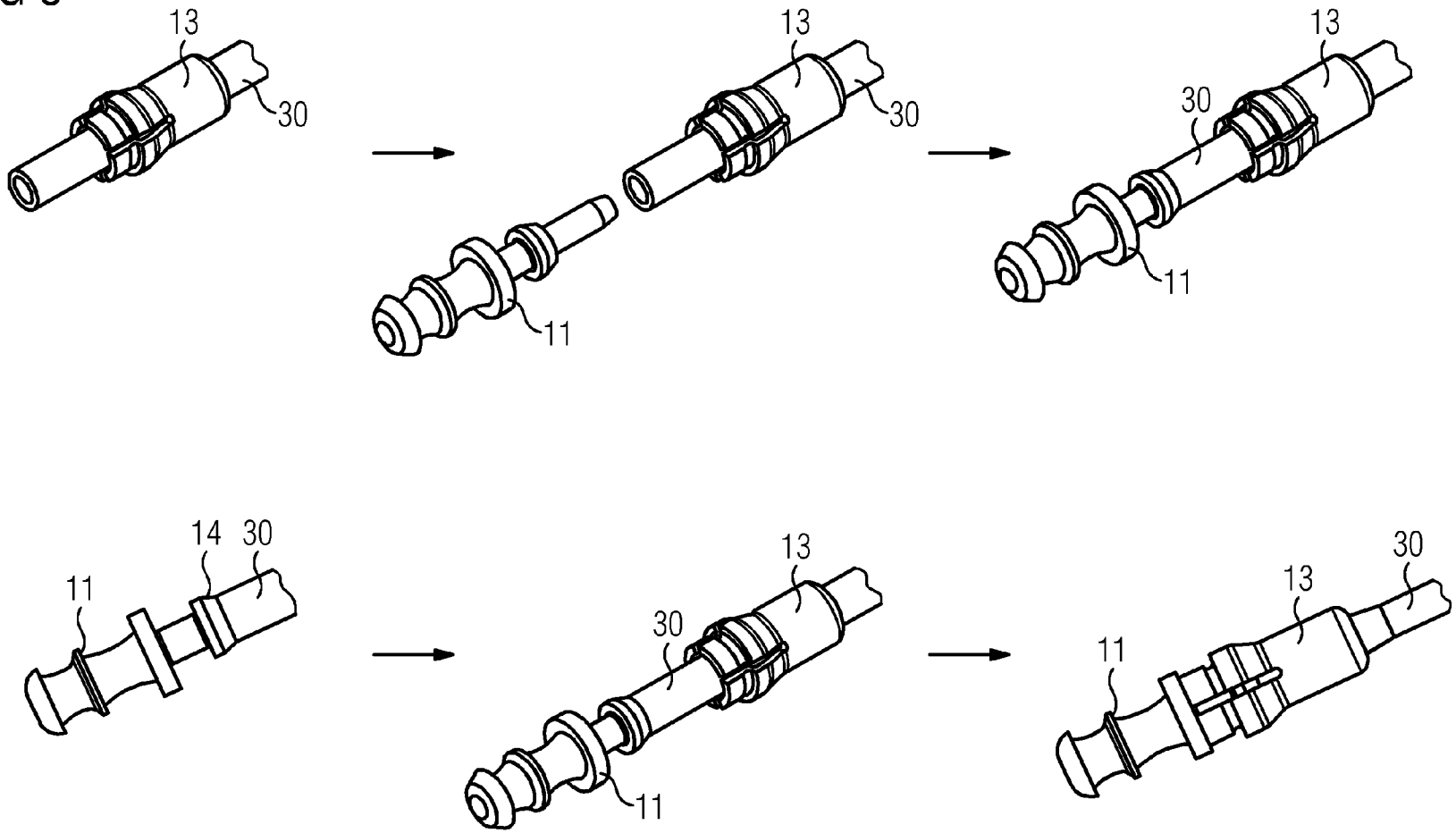
FIG. 8 is a fragmentary, perspective view showing in detail the application of a locking element according to the present invention.

FIG. 8 shows in detail how the adaptor 10 is fixed to the tube 30. After the locking element 13 has been pushed over the tube 30, the tube length maybe cut as required for the wearer. Then the adaptor 10 is inserted into the tube 30. In this case, the adaptor 10 is inserted without the help of an insertion tool 12. The adaptor body 11 is provided with a flange 14, which stops the tube 30. After the tube 30 has been slipped over the adaptor body 11, the locking element 13 is pushed over the tube 30, thereby squeezing the elastic tube in between and fixing it to the adaptor 10.

Figure 9:
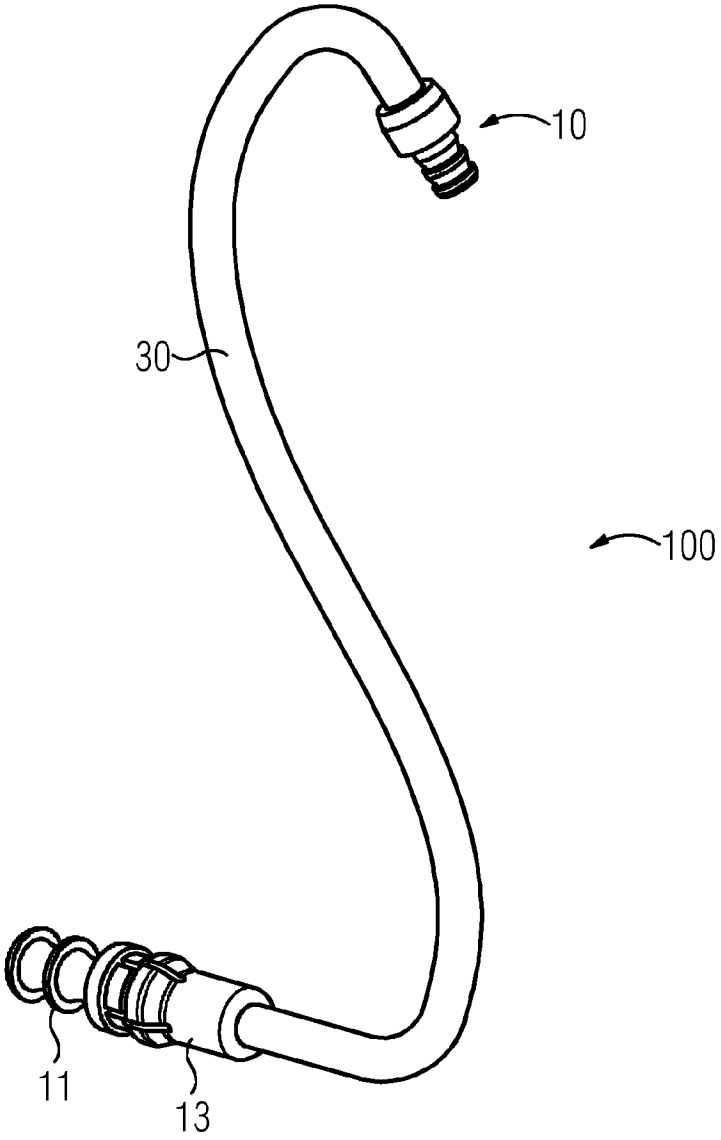
FIG. 9 is a perspective view of a tube system according to the present invention which is ready for application to a hearing aid.

FIG. 9 shows the complete tube system 100 after assembly.

Figure 10:
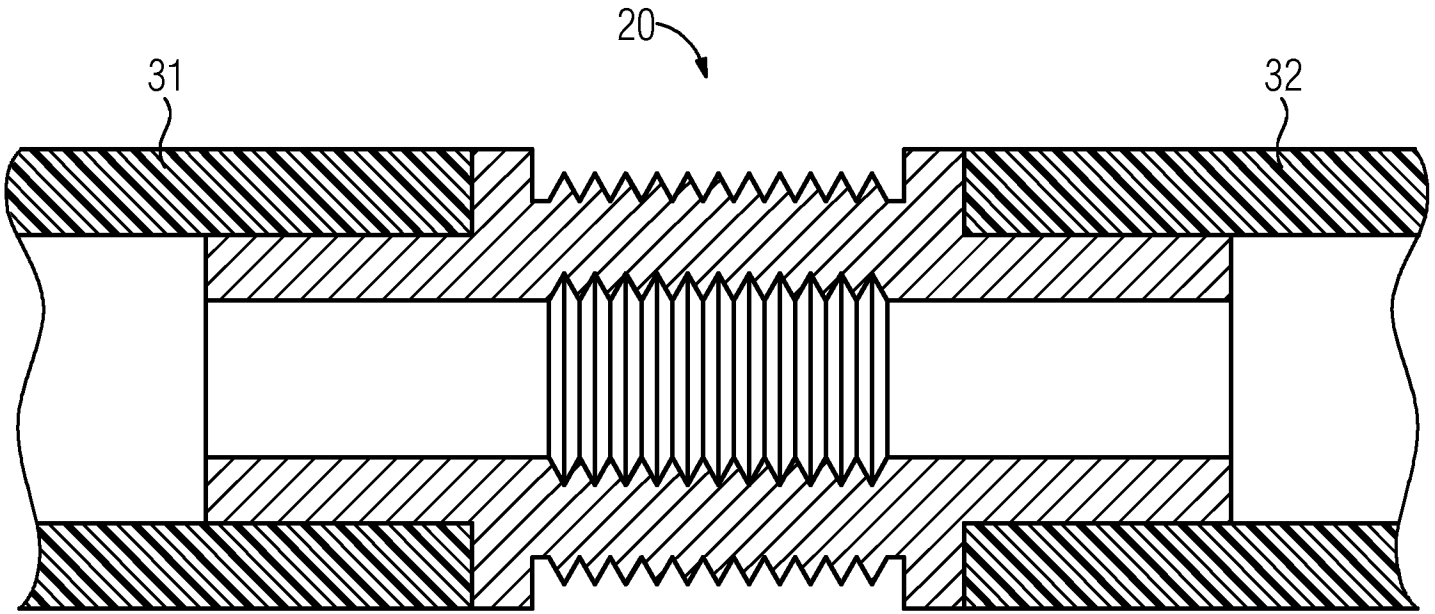
FIG. 10 is a longitudinal-sectional view of a connector element being adjustable in length for connecting two tube segments according to the present invention.

FIG. 10 shows an example of a connector 20 interconnecting two segments 31, 32 of the tube 30. In this embodiment, the connector 20 is provided with a flexible bellows which may be adjusted in length by applying longitudinal force. It is also possible according to an embodiment of the present invention to provide such a bellows integrally formed with the tube 30.

Figure 11:
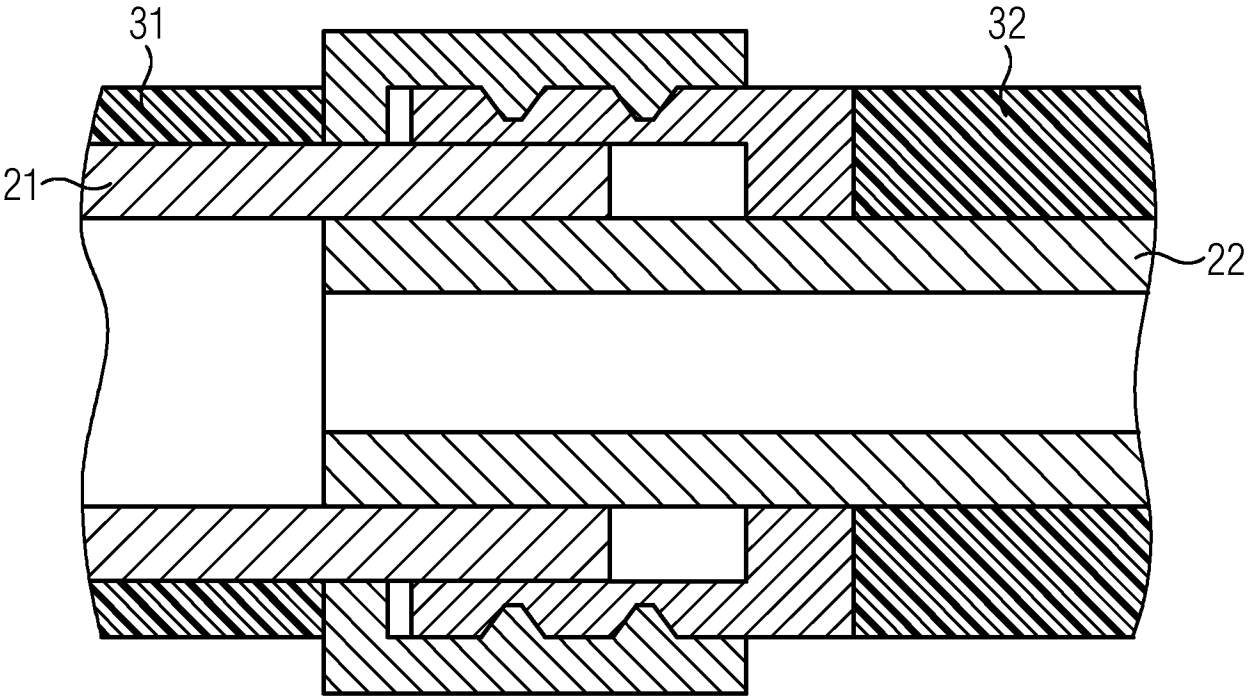
FIG. 11 is a longitudinal-sectional view of another connector element being adjustable in length for connecting two tube segments according to the present invention.

FIG. 11 shows a connector 20 providing a first sub-element 21 and a second sub-element 22 with a telescopic slide-out. The two sub-elements 21, 22 are formed in such a way that they can be plugged into each other, thereby providing a hermetically closed connection between the first tube segment 31 and the second tube segment 32. The two sub-elements 21, 22 may be moved relative to each other within certain limits without losing the connection. Devices may be provided on opposite surfaces of the two sub-elements to fix the first sub-element 21 and the second sub-element 22 in position relative to each other. Such devices may e.g. be grooves and bumps as indicated in FIG. 11.

Figure 12:
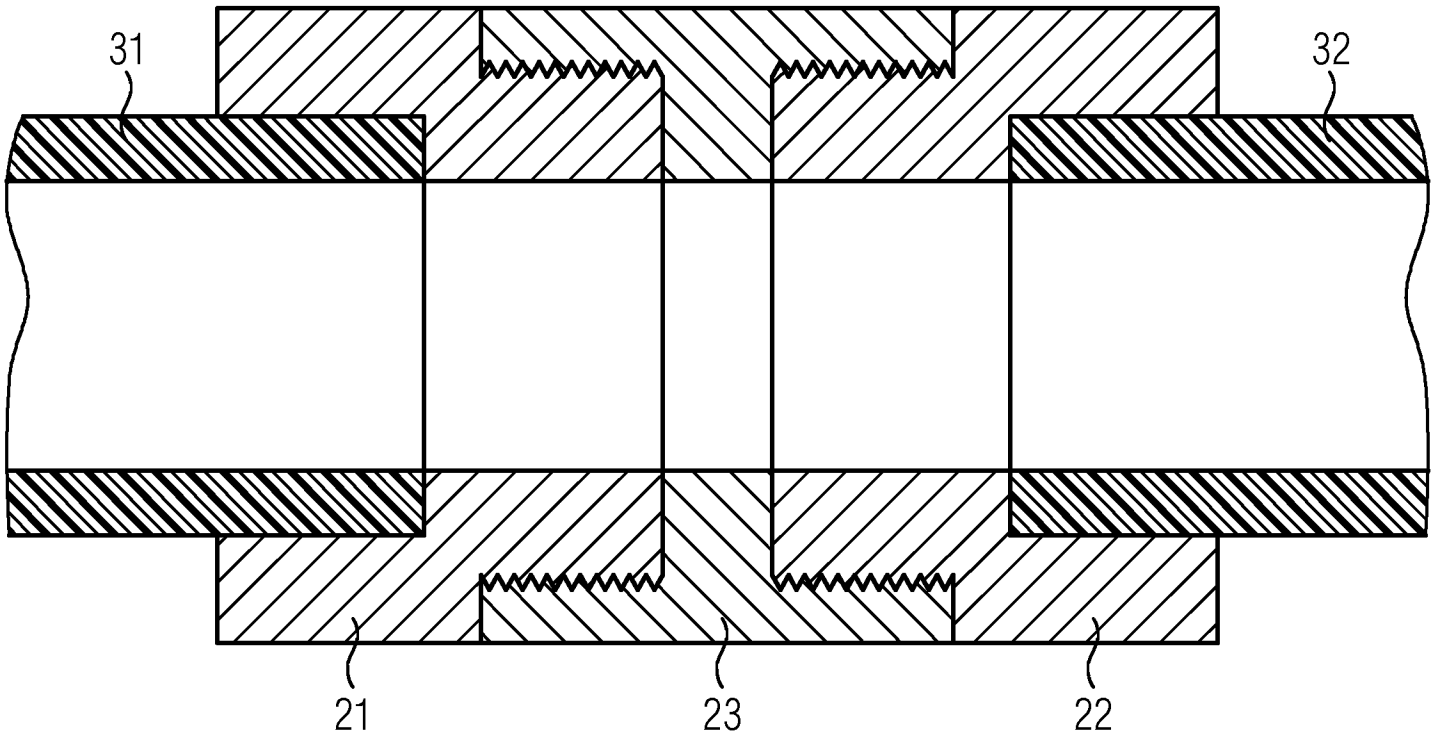
FIG. 12 is a longitudinal-sectional view of another connector element being adjustable in length for connecting two tube segments according to the present invention.

FIG. 12 shows another embodiment, wherein the two sub-elements 21 and 22 are interconnected by a third sub-element 23. The sub-elements may be provided with threads on opposite surfaces, in such a way that the length of the connector 20 maybe adjusted by turning the sub-element 23 relative to the sub-elements 21, 22.

Figure 13:
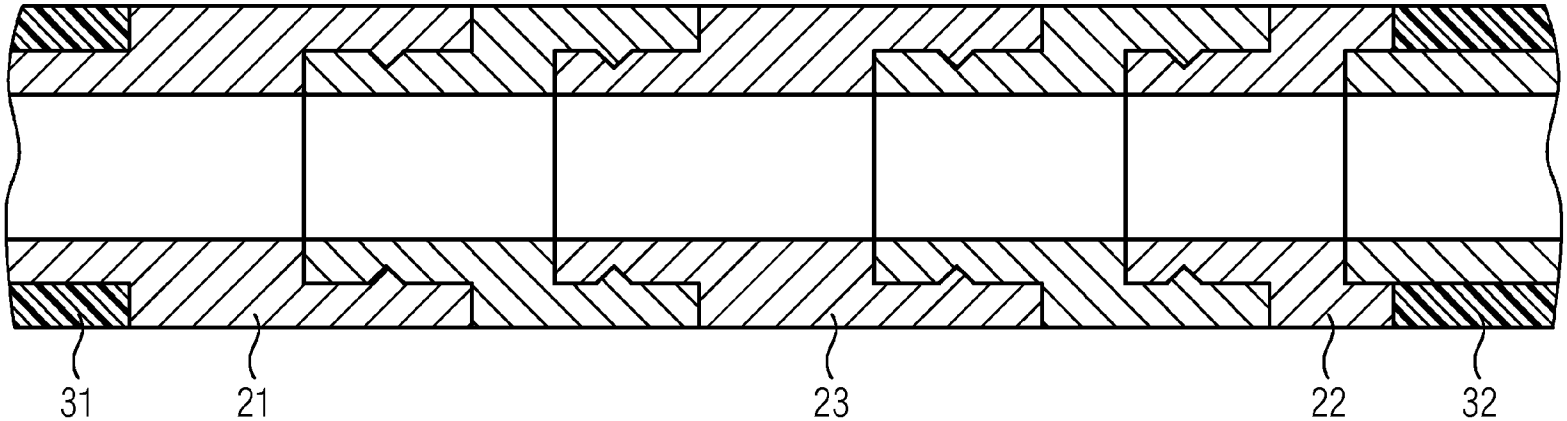
FIG. 13 is a longitudinal-sectional view of another connector element being adjustable in length for connecting two tube segments according to the present invention.

FIG. 13 shows another embodiment of the connector 20, wherein the third sub-element 23 may be provided in different lengths or a plurality of sub-elements 23 may be stacked and inserted between the sub-elements 21 and 22, thereby adjusting the length.

Figure 14:
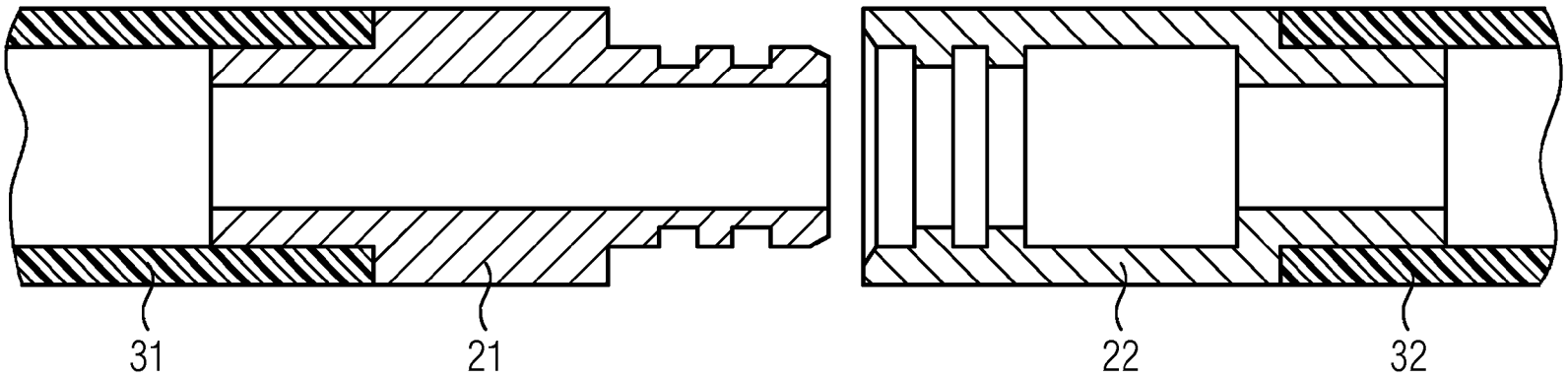
FIG. 14 is an exploded, longitudinal-sectional view of another connector element being adjustable in length for connecting two tube segments according to the present invention.

FIG. 14 is similar to FIG. 11, but the telescopic slide-out is provided in a simpler construction.

The invention claimed is:

1. In an adjustable length tube system having a tube for providing a sound connection between a hearing aid body with a receiver and an ear piece of a hearing aid, an adaptor, comprising:

an integrally formed frangible insertion tool configured to insert the adaptor into the tube;

said insertion tool being broken from the adapter after insertion.

2. The adaptor according to claim 1, which further comprises a connector element with an adjustable length being integrally formed with the tube.

3. The adaptor according to claim 2, wherein said connector element is configured to releasably interconnect two tube segments of the tube system.

4. The adaptor according to claim 3, wherein said connector element has an adjustable length.

5. The adaptor according to claim 4, wherein said connector element includes a first sub-element and a second sub-element configured to be connected to the tube segments, and at least one third sub-element configured to interconnect said first sub-element and said second sub-element.

6. The adaptor according to claim 4, wherein said connector element includes a first sub-element and a second sub-element configured to be connected to the tube segments, said sub-elements having devices for releasable engaging in a plurality of positions relative to each other.

* * * * *